US005567071A

United States Patent [19]

Lepsius et al.

[11] Patent Number: 5,567,071

[45] Date of Patent: Oct. 22, 1996

[54] METHOD AND APPARATUS FOR REFILLABLE STICK DISPENSER

[75] Inventors: Tilwin Lepsius, Duesseldorf; Gerhard Gierenz, Solingen; Klaus Tranelis, Muelheim; Gerd-Ruediger Reinfelder, Meerbusch; Joachim Franken, Duesseldorf; Hans Halm, Herne, all of Germany

[73] Assignee: Henkel Kommanditgesellschaft auf Aktien, Duesseldorf, Germany

[21] Appl. No.: 415,030

[22] Filed: Mar. 30, 1995

Related U.S. Application Data

[63] Continuation of Ser. No. 50,460, filed as PCT/EP91/02098, Nov. 6, 1991 published as WO92/08358, May 20, 1992, abandoned.

[30] Foreign Application Priority Data

| | | | |
|---|---|---|---|
| Nov. 15, 1990 | [DE] | Germany | 40 36 396.1 |
| Apr. 16, 1991 | [DE] | Germany | 41 12 432.4 |
| Jun. 25, 1991 | [DE] | Germany | 41 20 969.9 |

[51] Int. Cl.[6] ..... B05C 17/00; A45D 40/06

[52] U.S. Cl. ..... 401/68; 401/75; 401/87; 401/98; 401/175

[58] Field of Search ..... 206/385; 222/326, 222/327; 401/63, 68, 75, 78, 79, 72, 70, 98, 86, 87, 175; 132/318

[56] References Cited

U.S. PATENT DOCUMENTS

| | | | |
|---|---|---|---|
| 1,194,545 | 8/1916 | Remington | 401/75 |
| 1,218,393 | 3/1917 | Gensmer | 401/175 |
| 1,947,738 | 2/1934 | Reutter . | |
| 2,574,405 | 11/1951 | Lynn | 401/63 X |
| 2,753,991 | 7/1956 | Sherman | 206/56 |
| 2,921,675 | 1/1960 | Clark et al. | 401/78 |
| 3,217,869 | 11/1965 | Katz et al. . | |
| 3,230,960 | 1/1966 | Moore et al. | 401/98 X |
| 3,907,441 | 9/1975 | Idec et al. | 401/75 |
| 3,913,595 | 10/1975 | Grisel | 401/75 |
| 4,602,886 | 7/1986 | Smit | 401/35 |
| 4,699,161 | 10/1987 | Smith et al. | 401/68 X |

FOREIGN PATENT DOCUMENTS

| | | | |
|---|---|---|---|
| 0632125 | 1/1928 | France . | |
| 1074425 | 10/1954 | France . | |
| 1205370 | 2/1960 | France . | |
| 1283961 | 1/1962 | France | 401/175 |
| 2312420 | 5/1975 | France . | |
| 1003411 | 2/1957 | Germany . | |
| 572732 | 12/1956 | Italy | 401/79 |
| 561818 | 4/1957 | Italy | 401/79 |
| 219036 | 5/1942 | Switzerland | 401/175 |
| 249752 | 7/1947 | Switzerland | 401/75 |
| 0246657 | 2/1926 | United Kingdom . | |
| 1280635 | 7/1972 | United Kingdom | 401/175 |

*Primary Examiner*—Steven A. Bratlie
*Attorney, Agent, or Firm*—Ernest G. Szoke; Wayne C. Jaeschke; Kenneth Watov

[57] ABSTRACT

A refill cartridge for a stick product dispenser, for stick products including adhesive sticks, lipsticks, release agent sticks, shaving soap sticks, coloring sticks, and so forth, is provided by molding the stick product material to have a shape substantially the same as the internal shape of the associated dispenser casing or holder, and to fill the free internal volume of the holder. When the stick product originally within the dispenser is used, the refill cartridge is partially inserted into an open end of the empty dispenser holder, and the cartridge is either pushed or drawn into the dispenser, for refilling the same with the desired stick product, and permitting non-consumable portions of the stick product dispenser to be repeatedly reused via such refilling.

11 Claims, 4 Drawing Sheets

METHOD AND APPARATUS FOR REFILLABLE STICK DISPENSER

This application is a continuation of application Ser. No. 08/050,460, filed as PCT/EP91/02098, Nov. 6, 1991 published as WO92/08358, May. 20, 1992 now abandoned.

This application is related to divisional application Ser. No. (Attorney Docket No. D 9190 IIA) filed on Mar. 27, 1995.

BACKGROUND

1. Field of the Invention

The field of the present invention relates generally to stick product dispensers, and more particularly to refill cartridges for associated stick product dispensers.

2. Discussion of Related Art

There are already various known dispensers for sticks which release product by application to a surface, such as deodorant, adhesive, lipstick, release agent, shaving soap or coloring sticks, comprising a holder which is optionally designed for closure by a cap, has an opening at at least one end and comprises a plunger designed for axial displacement over the length of the holder to apply a preferably spreadable product mass accommodated in the holder. These known sticks have the disadvantage that they are generally not refillable.

For example, dispensers or containers for adhesive sticks known from the prior art have to be discarded after the adhesive has been used up or has dried out although, in general, the adhesive stick dispensers mechanism is still in perfect working order after the original adhesive filling has been used up. Accordingly, known dispensers for stick products such as adhesive sticks, create plastic waste, and are a significant source of environmental pollution. In addition, new material (plastic) always has to be used in the production of a new stick dispenser which, besides the production costs, adversely affects the manufacturing price. Finally, the consumer is also forced to buy a completely new stick product dispener every time.

SUMMARY OF THE INVENTION

The problem addressed by the present invention is to enable the essential, non-consumable parts of a dispenser for stick products of the above-mentioned kind, for example, to be repeatedly reused.

A refilling method of one embodiment of the invention, a molding of the particular, preferably spreadable, product mass is configured to have the same to the internal volume and is pushed and/or drawn into the holder from an opening at one end thereof. The refill stick in one embodiment of the invention, is provided as a molded stick product configured to have the same internal volume and configuration as the associated stick product dispenser, whereby the refill stick product can be merely pushed into the empty stick product dispenser, for refilling the same. If the stick product dispenser is provided, for example, with a screwthreaded spindle, a refill stick can be drawn into the holder or dispenser from the opening at its end. After the original product filling has been used up, the consumer is thus able to refill the stick dispenser. The consumer no longer has to buy a completely new stick dispenser. Because the key, non-consumable parts of the associated dispenser are reused, the amount of waste, typically plastic waste (because the dispensers are normally made of plastic), is reduced. The consumption of plastic is also reduced because the manufacturer no longer has to market each stick product together with an associated stick dispenser containing the entire stick mechanism, since a portion of the stick products can be sold in refill form.

In another embodiment of the invention, refilling of the stick is facilitated by the fact that a tube or refill cartridge holding a molding of the particular, preferably spreadable, product mass adapted to the internal volume and internal configuration of the holder or dispenser is fitted onto the dispenser, and the molding is pushed and/or drawn into the dispenser. This prevents the product mass, which is soft and plastic, particularly in the case of adhesive sticks, from being locally stripped at the front edge of the stick dispenser during refilling so that the stick product is not soiled.

In another embodiment of the invention, convenient refilling without stripping of a soft and plastic stick product during introduction of the stick into the dispenser can also be obtained if the refill cartridge is provided with a plunger so that, after the product has been used up, the plunger of the dispenser is first removed from the empty dispenser, and a molding of the particular, preferably spreadable, product mass is fitted with a plunger at one end, and is inserted and/or drawn plunger end first into the dispenser.

To refill a product dispenser consisting of

- a holder with a closed base into which a stick product rotatable about its longitudinal axis is fitted by means of a snap-in joint, the stick product extending over the entire longitudinal axis of the holder being formed by a screwthreaded spindle beyond one side of a snap-in joint, and by a hand-operated knurled nut beyond the other side of the snap-in joint outside the holder, and further including
- a plunger non-rotatably mounted in the holder, being designed for displacement longitudinally of the holder by means of the screwthreaded spindle engaging in a screwthreaded bore extending throughout the plunger, and optionally including
- a closure cap designed to be pushed on over the upper edge of the holder, another embodiment of the invention is characterized in that a molding of the particular, preferably spreadable, product mass adapted to the internal volume and internal configuration of the holder and formed with a bore, preferably a blind hole, concentric to the longitudinal axis, is pushed and/or drawn into the holder from the opening at the end thereof. Because a molding formed with a bore or blind hole is introduced into the holder during refilling, little, if any, product mass has to be displaced by the screwthreaded spindle during introduction of the molding so that no volume into which the product mass could escape has to be provided in the stick dispenser for this purpose. In addition, no surplus volume of stick product mass escapes from the dispenser, leaving the stick product intact.

To enable a stick product having a screwthreaded spindle to be filled as conveniently and—in terms of potential soiling—as advantageously as described in the foregoing in reference to the refilling of a stick product comprising a molding with no blind hole, another embodiment of the invention is characterized in that a tube holding a molding of the particular, preferably spreadable, product mass which is adapted to the internal volume and internal configuration of the dispenser or holder, and which is formed with a bore, preferably a blind hole, concentrically to the longitudinal axis, is fitted onto the dispenser, and the molding is pushed and/or drawn into the holder.

Another embodiment of the invention is characterized in that, after the stick product has been used up, the plunger of the stick product is first removed from the empty holder or dispenser, and a molding of the particular, preferably spreadable, product mass fitted at its end with a plunger having a screwthreaded bore is screwed plunger end first onto the screwthreaded bore and, by rotation of an associated knurled nut, the plunger is drawn together with the product mass into the dispenser, to a position proximate the base of the holder.

Particularly convenient refilling of the dispenser is possible when the molding of preferably spreadable product mass is surrounded by a tube and provided at one end with a plunger. To this end, another embodiment of the invention is characterized in that the plunger is introduced into the dispenser surrounded by the tube at its upper edge and, as the product mass is drawn into the dispenser, the refill tube is completely pushed off or withdrawn from the plunger and from the molding and, finally, is removed. The preferably spreadable product mass is filled into a tubular refill holder having its base formed by the plunger in such a way that the outer surface of the plunger is surrounded by the upper end of the dispenser. If for example, the screwthreaded bore of the plunger is screwed onto the screwthreaded spindle, and if the plunger together with stick the product mass is drawn up to the base of the dispenser by rotation of the knurled nut, the molding or product stick is continuously withdrawn from the refill tube at the same time so that, finally, the refill tube can be removed from the dispenser. The dimensions of the refill tube must be such that, as the plunger is screwed down, the front end of the tube impinges on the opposite end of the wall of the dispenser, so that the tube is freed of the stick product.

In a process for the production of a refill cartridge or tube of the type mentioned at the beginning, the solution to the above-stated problem as provided by the invention is characterized in that stick product mass is introduced into a mold adapted to the internal volume and internal configuration of the holder or dispenser and, after solidification, is ejected from the mold as a molding of preferably spreadable product mass which forms the major part of the refill cartridge. Accordingly, by a very simple process, the invention provides a refill cartridge which can be loaded into an empty dispenser so that the dispenser can be refilled by an equally simple procedure.

In one embodiment of the process according to the invention for the production of a refill cartridge, a plunger optionally formed throughout with a central screwthreaded bore is introduced into the base of the mold, and the product mass is subsequently poured into the plunger and the mold. In this way, the plunger and the molding of preferably spreadable product mass form a single unit which can advantageously be introduced and/or drawn into the case of a dispenser. More particularly, this reduces the danger of the plunger being separated from the product mass during introduction of the molding into the dispenser.

To produce a refill cartridge in which the molding of preferably spreadable product mass is surrounded by a tube, a particularly advantageous embodiment of the invention is characterized in that the mold is widened to accommodate a tube and, before the product mass is poured in, a tube is introduced into the mold with its outer surface adjoining the inner surface of the mold.

In order specifically to apply the plunger to the base of the mold and, if desired, to form a bore or a blind hole in the molding during the production process, another embodiment of the process is characterized in that a stick product extending over at least part of the mold is arranged on the bottom of the mold concentrically to the longitudinal axis to receive the screwthreaded bore of the plunger, and/or to form a bore or a blind hole in the product mass.

In another particularly advantageous embodiment of the production process according to the invention, the stick product is an adhesive stick and the molding consists of adhesive.

In a refill cartridge of the type mentioned at the beginning, the solution to the above-stated problem as provided by the invention is characterized in that the refill cartridge consists essentially of a molding of the particular, preferably spreadable, stick product mass which is adapted to the internal volume and internal configuration of the dispenser. The molding of preferably spreadable product mass can be fitted onto, and pushed and/or drawn into, the stick dispenser from the opening at the end of the dispenser. The dispenser can be refilled in this way. The dispenser does not have to be discarded after the original product filling has been exhausted.

To facilitate loading of the refill cartridge into the dispenser for the stick, another embodiment of the cartridge is characterized in that, at its end, the molding comprises a plunger optionally formed throughout with a central screwthreaded bore.

To enable the refill cartridge to be used for refilling dispensers with a screwthreaded spindle without any danger of soiling of the dispenser, another embodiment of the refill cartridge according to the invention is characterized in that the molding is formed with a bore or blind hole concentrically to its longitudinal axis.

To prevent air from being trapped in the dispenser during introduction of the refill cartridge into the dispenser, a further embodiment of the refill cartridge according to the invention is characterized in that the molding is formed in its outer circumference with a longitudinal groove or notch.

As already mentioned in reference to the production process and the method for refilling a stick product, refilling of the stick product can also be facilitated if, in accordance with another embodiment, the molding is arranged in a tube.

The present invention also relates to a refill cartridge for a stick which consists of the following parts:

- a holder with a solid base into which a stick product rotatable about its longitudinal axis is fitted by means of snap-in joint, the stick product extends over the entire longitudinal axis of the dispenser including a screwthreaded spindle beyond one side of the snap-in joint, and a hand-operated knurled nut beyond the other side of the snap-in joint outside the dispenser,
- a plunger non-rotatably mounted in the holder, being designed for displacement longitudinally of the dispenser by means of the screwthreaded spindle engaging in a screwthreaded bore extending throughout the plunger, and optionally

- a closure cap designed to be pushed on over the upper edge of the holder.

This refill cartridge is characterized by a tube which surrounds the molding of the particular, preferably spreadable, stick product mass adapted to the internal volume and internal configuration of the dispenser, and which has a length adapted to the free internal height of the dispenser, an internal diameter adapted to the internal diameter of the dispenser, and a base serving as a plunger for the stick product, the upper edge of the plunger being surrounded by the tube.

As mentioned above, the refill cartridge comprises a tube which surrounds the preferably spreadable product mass and of which the length substantially corresponds to the free internal height of the dispenser, but may even be only a fraction of the internal height of the dispenser. The tube has an adapted internal diameter corresponding to that of the dispenser, so that the molding or stick product can be drawn into the interior of the dispenser with simultaneous withdrawal from of the tube or refill cartridge. To use the refill cartridge, that part of the plunger which is not covered by the tube is inserted into the dispenser to such an extent that, on rotation of the knurled nut of the dispenser, the screwthreaded spindle engages in the screwthreaded bore of the plunger. On further rotation of the knurled nut, the plunger is gradually drawn towards the base of the dispenser, the tip of the screwthreaded spindle—after passing through the screwthreaded bore in the molding—drawing the stick product mass evenly into the cylindrical dispenser with simultaneous "cutting" of a screwthread, in this example. Rotation of the knurled nut is continued until the plunger reaches the base of the holder. In this position, the molding or product stick has been fully withdrawn from the tube so that the tube may be removed. The refilled dispenser can now be closed by a closure cap at the open end of the dispenser, as known from the prior art. The refilling process may be repeated indefinitely because the plastic parts of the dispenser are not subjected to any significant wear when the knurled nut is rotated either to apply the particular stick product or to refill the holder.

To prevent the product mass from drying out on the side facing the plunger, the screwthreaded bore may be closed by a (thin) membrane designed to be pierced by the screwthreaded spindle. The screwthreaded bore of the plunger preferably has a single or multiple screwthread.

In the same way as all the other parts, the screwthreaded spindle of the dispenser is made of inexpensive plastic, optionally having a certain flexibility. To facilitate introduction of the spindle end into the screwthreaded bore of the plunger of the refill cartridge, the base of the plunger is formed internally with a cone as an insertion aid.

The tube may also be closed at that end opposite the plunger to prevent the product mass from drying out. For example, it is possible in this embodiment to prefabricate the tube in the form of a cup, and to fill this prefabricated cup with product mass before it is closed by the plunger on the open side of the cup.

So far as the dimensions of the tube are concerned, the only crucial factor is the internal diameter adapted to that of the stick product holder or dispenser. By contrast, the wall thickness of the tube may basically be selected as required, although to save material it should be at most equal to the wall thickness of the dispenser.

Similarly, the tube may be made of any material providing it remains rigid during withdrawal of the stick product molding. The tube is preferably made of plastic or paperboard which may be coated. By contrast, the plunger should preferably consist of plastic.

To enable the molding to be readily inserted into the dispenser, a central blind hole for the screwthreaded spindle may be provided along the axis of the molding. This embodiment enables the dispenser and the tube to have the same internal diameter. If no central blind hole is provided for the screwthreaded spindle, the internal diameter of the tube should be smaller in accordance with the increase in the diameter of the molding brought about by the cutting screwthreaded spindle.

Instead of a blind hole, it is also possible to provide a bore extending over the entire longitudinal axis of the molding.

To facilitate withdrawal of the molding, the inner surface of the tube is preferably made slightly conical in shape, the conical taper towards that end opposite the plunger forming a cone angle of at most 3°.

In another embodiment of the invention, the tube is provided at one end with a sleeve which encircles the plunger at a distance, and of which the internal diameter is such that the sleeve can be pushed on and over the upper part of the outer surface of the dispenser. In addition, the sleeve has an inner annular stop surface for the front end of the dispenser. Not only does this provide for safe fixing of the refill cartridge on the dispenser, it also guarantees centering of the tube of the refill cartridge upon the dispenser. The wall thicknesses of the dispenser and tube do not have to be exactly adapted to one another, in this example.

The dimensions of the sleeve are preferably such that the free end of the sleeve is level with, or projects slightly beyond, the base of the plunger. Looking in the axial direction, a sufficiently long annular space is thus created between the inner surface of the sleeve and the outer surface of the plunger.

In a first embodiment, the sleeve and the tube are made in one piece, more particularly by injection molding, the cross-section then being widened radially at the junction between the tube and the sleeve to create an annular stop surface for the front of the cylinder.

Alternatively, however, the tube and the sleeve may be made in two parts joined together by a preferably annular snap-in connection.

In another embodiment of the invention, the plunger and the sleeve are joined to one another by several bridges which break when the plunger is drawn towards the base of the dispenser, i.e. act as artificially weakened points. In this embodiment, the plunger and the sleeve may be made as a one-piece injection molding, optionally together with the tube. Alternatively, the plunger and the sleeve may be joined together by a drop-in or snap-in connection designed to break when the plunger is drawn towards the base of the dispenser, for example by forming small drop-in noses or hooks or the like in the injection molding process. These connections also separate from the sleeve after insertion of the screwthreaded spindle during the refill process.

The advantages mentioned above in connection with individual embodiments of the refill cartridge, the refill method and the production process apply both to the processes and to the refill cartridge, even if they are only mentioned in connection with one of the subjects of the invention.

BRIEF DESCRIPTION OF THE DRAWINGS

The invention is described in more detail in the following with reference to the accompanying drawings, in which like items are identified by the same reference designation, wherein.

DETAILED DESCRIPTION OF THE INVENTION

The example described in the following relates to an adhesive stick. Accordingly, the stick is termed an adhesive stick while the product mass is termed the adhesive mass. The product mass may be contained within a holder generally referred to as a dispenser, and typically consisting of a plastic material.

Similarly, the product mass would be termed the deodorant stick mass in the case of a deodorant stick, the release agent stick mass in the case of a release agent stick, the shaving soap stick mass in the case of a shaving soap stick and the coloring stick mass in the case of a coloring stick, i.e. generally the particular product mass is preferably spreadable and plastic.

Figure 1:
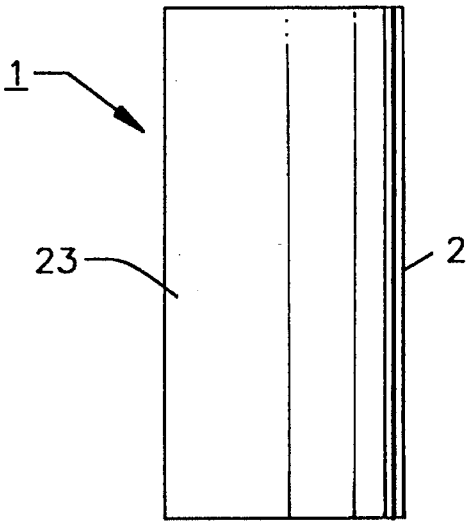
FIG. 1 is a side elevation of a refill cartridge.

The refill cartridge globally denoted by the reference 1 in FIG. 1 consists of a cylindrical molding 2 of plastic, spreadable adhesive mass 23. In its three-dimensional form, the stick or molding 2 is so adapted to the internal volume—designed to accommodate the adhesive mass—and internal configuration of an associated holder of the adhesive stick or product mass 23 that it can be introduced into in the direction of the arrow 3, and pushed and/or drawn completely into the holder. One example of such a stick is described in the following with reference to FIGS. 5 and 6. In its most simple form, the refill cartridge 1 is a smooth-surface cylindrical molding 2.

Figure 2:
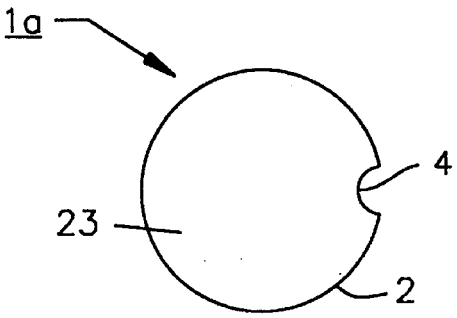
FIG. 2 is a top plan view of of a refill cartridge of one embodiment of the invention.

FIG. 2 is a plan view of a refill cartridge 1*a* of which the cylindrical molding 2 is provided on its outer circumference with a longitudinal groove or notch 4. Air is able to escape from the interior of the adhesive stick holder along this groove 4 when the molding 2 is introduced into the holder.

Figure 3:
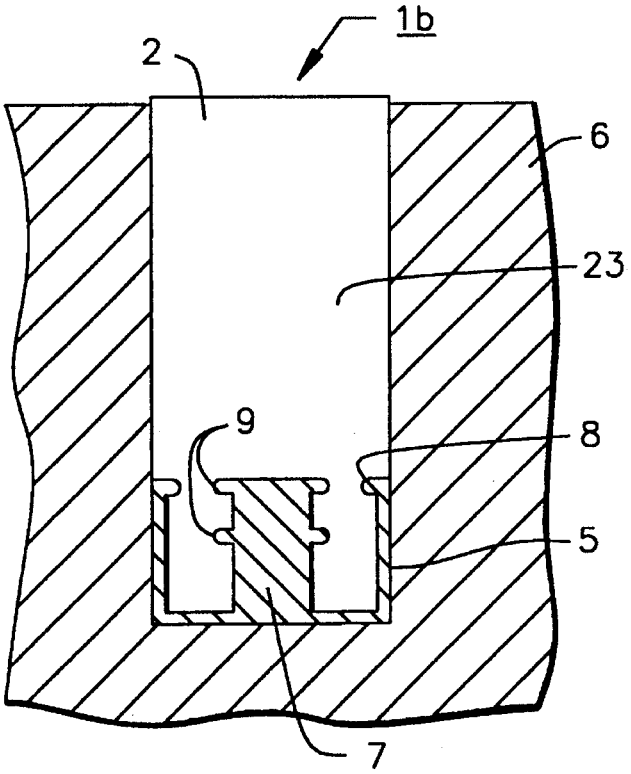
FIG. 3 shows another embodiment of a refill cartridge with part of a mold.

FIG. 3 shows a refill cartridge 1*b* of which the molding 2 of spreadable adhesive mass 23 is provided at one end with a plunger 5. FIG. 3 shows the refill cartridge 1*b* still in the mold 6 (partly shown) immediately after casting of the adhesive mass 23, which is still liquid during the production process, and its solidification. Overall, the plunger 5 is cup-shaped with a cylindrical projection 7 at its center. Annularly projecting collars 8 and 9 are formed on the inside of the plunger 5 and the outside of the cylindrical projection 7. These collars ensure safe anchoring of the adhesive mass 23 in the cup-shaped plunger 5 and prevent the plastic adhesive mass 23 from being torn or sheared off during introduction of the refill cartridge 1*b* into the holder of an adhesive stick.

Figure 4:
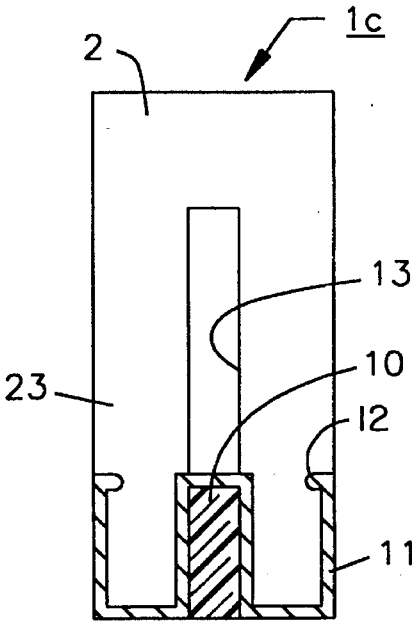
FIG. 4 shows yet another embodiment of a refill cartridge.

FIG. 4 shows another embodiment of a refill cartridge 1*c* of which the molding 2 of spreadable adhesive mass 23 comprises at one end a plunger 11 formed at its center with a screwthreaded bore 10 extending over the entire length of the plunger 11. Like the plunger 5, the plunger 11 is cup-shaped and is provided on its inside with annularly projecting collars 12. A blind bore 13 is formed in the molding 2 concentrically to its longitudinal axis.

The refill cartridges 1, 1*a*, 1*b* and 1*c* shown in FIGS. 1 to 4 may be longitudinally surrounded (not shown) by a tube, as described in the following with reference to the embodiments of the refill cartridges 1*d* and 1*e*.

Figure 5:
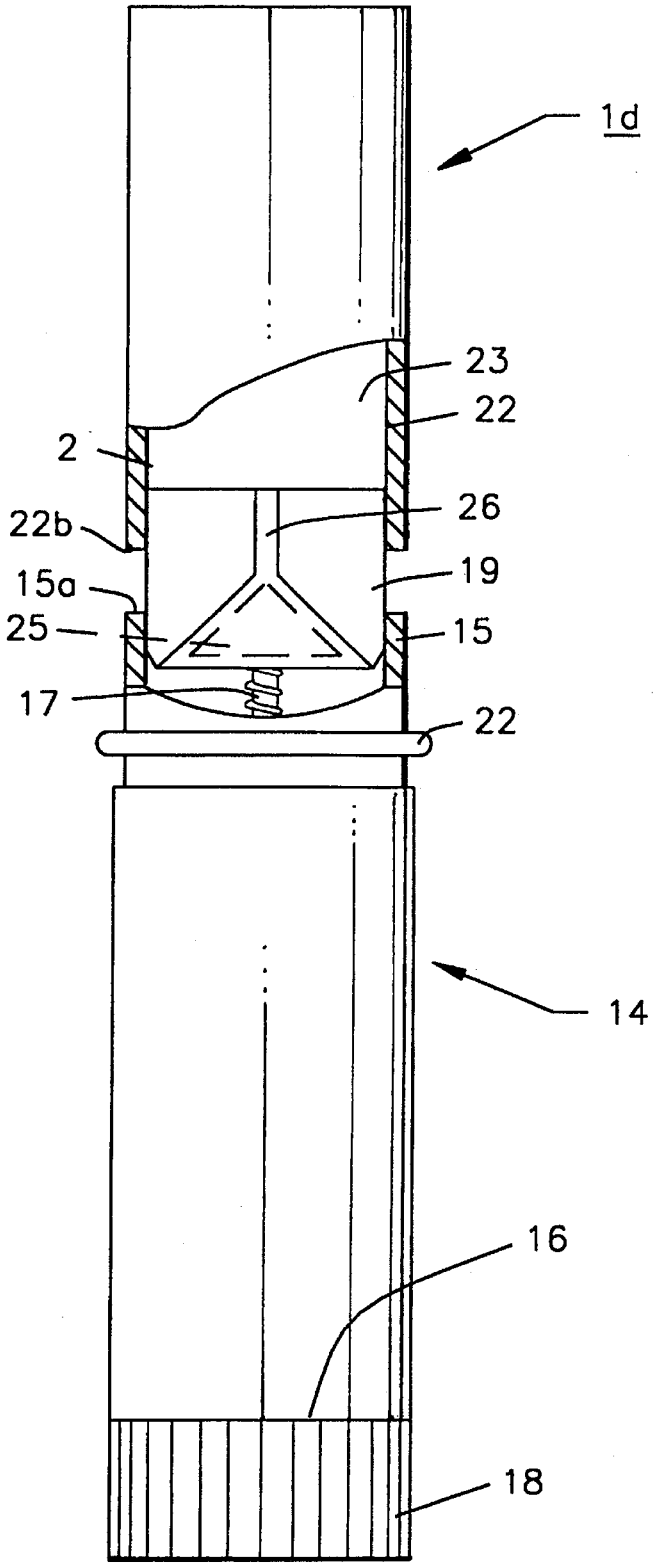
FIGS. 5 and 6 are each side elevations, partly broken and in section, of an adhesive stick surmounted by a refill cartridge other embodiment of the invention.
Figure 6:
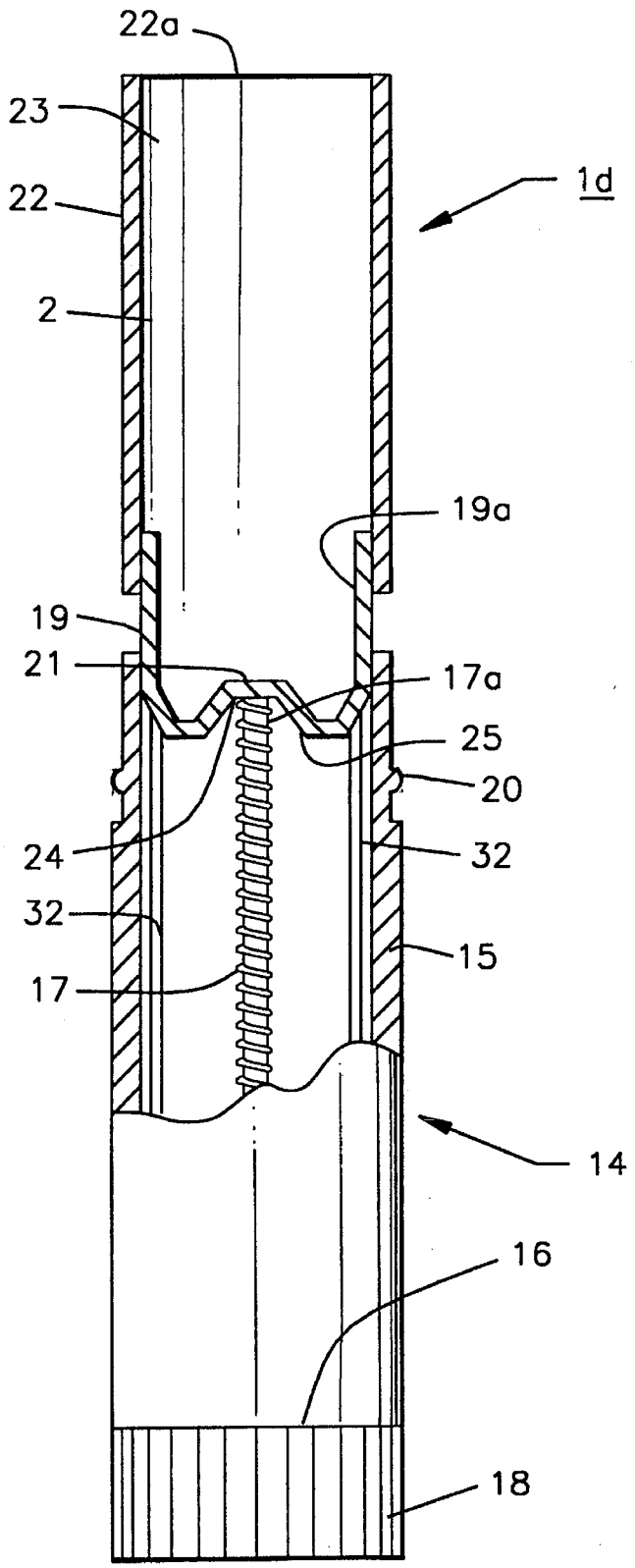

The adhesive stick or dispenser 14 shown in FIGS. 5 and 6 is known in principle from the prior art. It consists of a holder 15 with a solid base 16 into which a stick 14 rotatable about its longitudinal axis is fitted by means of a snap-in joint (not shown). The stick 14, which extends over the entire longitudinal axis of the holder 15, is formed by a screwthreaded spindle 17 beyond one side of the snap-in joint and by a hand-operated knurled nut 18 beyond the other side of the snap-in joint outside the holder 15. A plunger 19 is mounted in the holder 15 for longitudinal displacement by means of the screwthreaded spindle 17. Since the fitted refill cartridges 1*d* are shown in FIGS. 5 and 6, the closure cap which is normally designed to be pushed on over the upper edge of the holder is not shown. It can be removably fixed to the outside of the holder by means of drop-in connections 20 or screwthreaded or snap-in joints.

In its base, the plunger 19 is formed with a screwthreaded bore 21 in which the screwthreaded spindle 17 is designed to engage. The plunger 19 forms the bottom part of the refill cartridge 1*d* which otherwise consists of a tube 22 of which the lower rim encloses and/or surrounds the upper edge of the plunger 19. The upper end 22*a* of the tube 22 may be closed to prevent the spreadable adhesive mass 23 from drying out. In addition, the plunger base of the refill cartridge 1*d* to be introduced may have a breakable membrane 24 which closes the screwthreaded bore 21. The cone 25 formed on the inside of the plunger base acts as an insertion aid. In addition, the plunger 19 is formed on its outer surface along its longitudinal axis with groove-like depressions 26 which widen triangularly towards the underneath of the plunger and which, in conjunction with corresponding ribs 32 on the inner surface of the holder, prevent the plunger 19 from rotating when the knurled nut 18 is turned.

Figure 7:
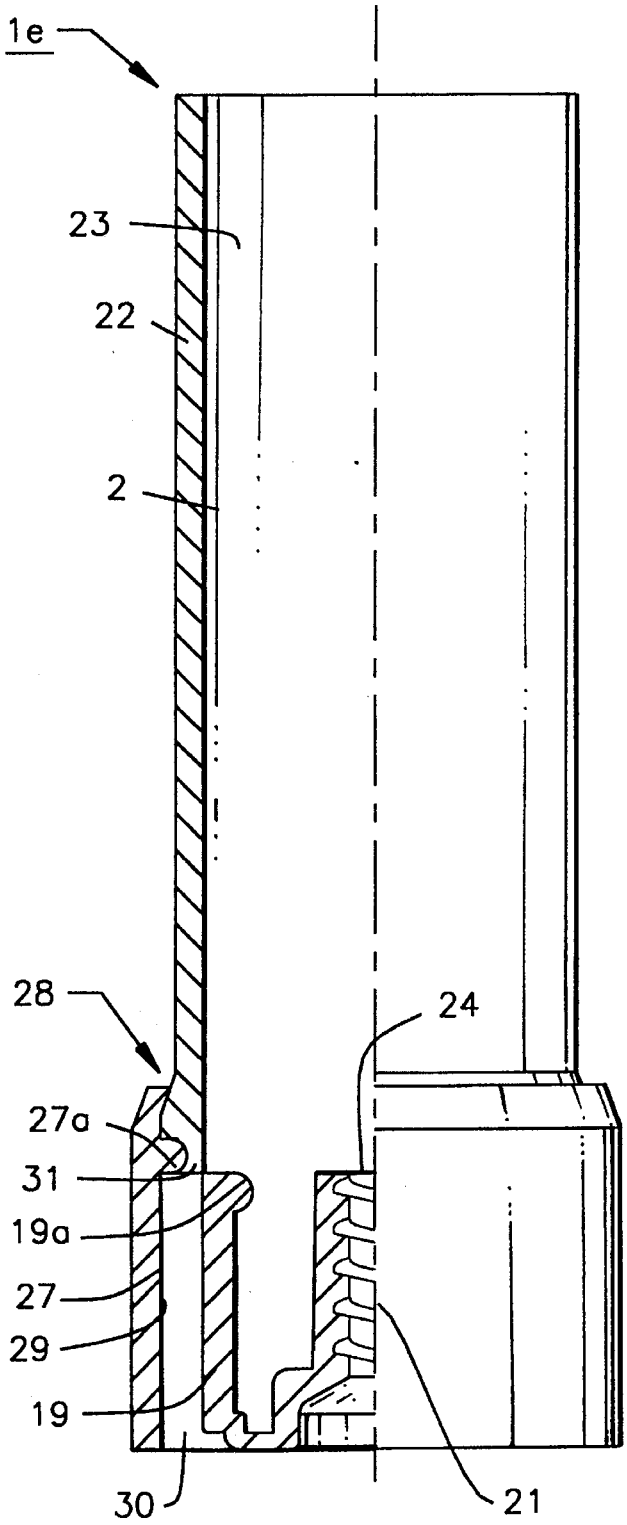
FIG. 7 is a cross-section/side elevation of another embodiment of a refill cartridge of the invention.

Another alternative embodiment is shown in FIG. 7 where the main difference from the above-described refill cartridges 1, 1*a*, 1*b*, 1*c*, 1*d* lies in the development and use of a sleeve 27. In the same way as the tube 22, the sleeve 27 is cylindrical in shape and is connected to the tube 22, for example by an annular snap-in joint 28. The sleeve 27 has an internal diameter 29 configured to permit it to be pushed onto the outside of the holder 15 (see FIGS. 5 and 6). The holder 15 slips into the annular space 30 between the sleeve 27 and the plunger 19, the refill cartridge 1*e* being securely fixed and centered in relation to the adhesive stick 14.

In the present case, the sleeve 27 is pushed over the holder 15 until the face 15*a* (see FIG. 5) and the annular stop surface 27*a* are in contact with one another.

However, the sleeve 27 can also be made in one piece with the tube 22, in which case the inner radial cross-section is increased in the vicinity of the connection between the tube 22 and the sleeve 27 with formation of an annular face similar to the stop surface 27*a*.

The plunger 19 is joined to the sleeve 27 by radially extending bridges 31 which break during the refill process, i.e. when the plunger 19 is moved towards the base 16 of the holder, so that the plunger is separated from the sleeve 27. In the embodiment in which the tube 22 and the sleeve 27 are made in one piece, the plunger 19 may also be connected to the above-mentioned one-piece molding 22, 27 by a releasable drop-in or snap-in connection. All parts may be injection moldings which, if they are in one piece or are to be joined to one another, may even be produced in a single operation.

The cross-sectional geometry of the refill cartridges 1, 1*a*, 1*b*, 1*c*, 1*d*, 1*e* must of course be adapted to that of the holder 15 of the adhesive stick 14; for example, the adhesive stick could even be polygonal rather than cylindrical.

The blind hole 13 is preferably of such a diameter that, on entering the blind hole 13, the screwthreaded spindle 17 cuts only slightly into the adhesive mass 23 so that there is little, if any, radial expansion of the molding 2 or displacement of the adhesive mass 23 on introduction into the holder 15.

To produce the moldings 2 of the refill cartridges 1 and 1*a*, the adhesive mass which is still liquid during the production process is poured into molds 6 which are adapted in shape to the internal volume—designed to accommodate the adhesive mass—and internal configuration of the holder 15. The molds may be made of metal, plastic or silicone rubber. The molds are preferably integrated into a cooling belt. The molds pass through a cooling zone until the adhesive mass 23 has solidified and the molding 2 has formed. To produce the refill cartridge 1, the corresponding mold is in the form of a hollow cylinder with a solid base. To produce the refill cartridge 1*a*, a longitudinally extending rib or a bridge projecting into the mold is additionally formed in the corresponding mold to form the notch 4. To produce the refill cartridge 1*b*, the plunger 5 is first introduced into the mold and the still liquid adhesive mass 23 is subsequently poured into the plunger 5 and the mold 6. To produce the refill cartridge 1*c*, the plunger 11 is again initially introduced into a mold. A pin extending longitudinally over at least part of the mold is arranged beforehand on the bottom of the mold concentrically to the longitudinal axis to receive the screwthreaded bore 10 of the plunger 11 and to form the blind hole 13. If the molding 2 of the refill cartridge 1*c* is not to have a blind hole 13, the pin merely has a length corresponding to the screwthreaded bore 10. If, by contrast, a blind hole 13 is to be formed in the molding 2, the pin projects into the region of the molding 2 over the length of the blind hole 13 which corresponds to the length over which the screwthreaded spindle 17 of the adhesive stick 14 is subsequently to penetrate into the molding 2. In this case, too, the liquid adhesive mass 23 is poured into the mold after introduction of the plunger 11 into the mold and positioning of the screwthreaded bore 10 onto the central pin. After solidification, the refill cartridges 1*b* and 1*c* are also ejected from their respective molds.

In cases where the refill cartridge or the adhesive molding 2 is to be surrounded by a tube 22, the tube 22 is first introduced into the mold and, if desired, a plunger 5, 11 or 19 is pushed through the tube 22 into the mold before the adhesive mass 23 is poured into the tube 22.

Refill cartridges with a tube 22 surrounding the molding 2 are produced using molds which, over part of their length, have a widening into which the particular tube 22 is to be positively fitted. The base of these molds is slightly below the lower edge of these openings so that either an inserted plunger or the inflowing adhesive mass can penetrate more deeply into the mold so that, in the finished refill cartridge, either adhesive or the plunger subsequently projects beyond the tube and the refill cartridge can thus be introduced with this region first into the holder of the adhesive stick to be refilled with adhesive.

In the case of multiple-part molds which can be parted after solidification of the adhesive mass, it is also possible to provide on the base of the mold recesses or widenings into which the plungers 5, 11 or 19 can be exactly fitted so that a projection is formed on the end of the plunger between the external diameter of the plunger and the external diameter of the particular molding of spreadable adhesive mass. This reduces the danger of contact with the adhesive mass where the plunger is used as an insertion aid for manual insertion of the refill cartridge into the adhesive stick holder.

After their ejection from the particular molds, the various refill cartridges 1–1*e* may be packed in the usual way in films, paper or film/paper composites. Sealed-rim bags, thermoformed parts, moldings of groundwood pulp or starch derivatives, for example, are also possible. Several refill cartridges may also be accommodated in a single pack from which they may be individually removed, for example by tearing or breaking off.

It is also possible to line the mold 6 with packaging material, for example plastic film, before it is filled with the adhesive mass 23. In this case, the packaging material acts as a separation aid and facilitates ejection of the solidified mass from the mold 6. An almost ready-packed refill cartridge 1–1*e* is also obtained in this way. To this end, the packaging material is introduced before the adhesive mass 23 is poured into the mold 6 and before the optional introduction of plungers 5, 11, 19 and/or the tube 22, optionally with the sleeve 27, preferably in such a way that it conforms closely to the inner surfaces of the mold.

To refill adhesive sticks 14, the packaging material surrounding the particular refill cartridge 1–1*e* is first completely or partly removed.

A packaging-free end of the refill cartridge 1–1*e*, which is either a part of the molding 2 or a plunger 5, 11 or 19, is then applied to or inserted into the opening in the end of an adhesive stick holder 15 and the refill cartridge is subsequently pushed and/or drawn into the holder 15. The refill cartridge is always drawn in when the adhesive stick 14 has a screwthreaded spindle 17 of which the screwthreads engage in a screwthreaded bore of a plunger 5, 11 or 19 and/or a blind hole 13. If the adhesive stick 14 to be refilled does not have a screwthreaded spindle, the particular refill cartridge 1–1*e* is pushed by hand into the adhesive stick holder 15. Refilling of the adhesive stick 14 shown in FIGS. 5 and 6 is described by way of example in the following. The refill cartridge 1*d* is first pushed gently with the plunger 19 into the holder 15 until the end 17*a* of the screwthreaded spindle comes into contact with the membrane 24. With a slight jerk, optionally accompanied by rotation of the knurled nut 18, the membrane 24 is pierced and the plunger 19 is pushed downwards until the screwthread of the screwthreaded spindle 17 engages in the screwthreaded bore 21. Through continued rotation of the knurled nut 18, the piston 19 is drawn further downwards until the front face 22*b* on the rim side comes into contact with the opposite front face 15*a* of the holder 15. With continued rotation of the screwthreaded spindle 17 through rotation of the knurled nut 18, the plunger 19 is drawn continuously downwards, the screwthreaded spindle 17 simultaneously cutting a thread into the adhesive mass 23 and pulling the molding 2 uniformly downwards. The position of the tube 22 relative to the holder 15 remains unchanged so that, finally, the column of adhesive 23 is completely removed from the tube 22. Since the length of the tube is adapted to the internal height of the holder, the free end face of the adhesive mass 23 is flush with the upper edge of the holder 15 so that the tube 22 can be removed completely empty. The adhesive stick 14 has been refilled and can be reused.

The other refill cartridges 1–1*e* may also be similarly pushed or drawn into their respective adhesive stick holders 15 in such a way that they are subsequently arranged flush with the front edge of the holder in the adhesive stick 14.

Although various embodiments of the invention have been shown and described, they are not meant to be limiting. Those of skill in the art may recognize modifications to these embodiments, which modifications are meant to be covered by the spirit and scope of the appended claims.

What is claimed is:

1. A method for refilling a stick adhesive dispenser which releases adhesive by application to a surface, comprising a holder which is designed for closure by a cap, has an opening at a top end and comprises a screw threaded spindle axially aligned and centrally located with a free end at said opening, and an opposite end connected to the center of a hand rotatable knurled nut secured to a lower end of said holder, a replaceable plunger designed to engage said spindle for axial displacement over the length of said holder via turning of said knurled nut to apply said stick adhesive accommodated in said holder, wherein the improvement comprises the steps of:

molding said stick adhesive to have a volume and form substantially the same as the internal configuration of said holder, and to have a central axially aligned blind hole exiting at one end of said stick adhesive;

securing a said replaceable plunger on said one end of said stick adhesive, with said replaceable plunger having a central threaded bore located opposing said blind hole;

retaining the molded said stick adhesive in a refill tube closed at one end, and open at the opposite end, with said replaceable plunger protruding from the opposite end;

removing a spent plunger, if any, from said spindle;

fitting said refill tube onto said holder in a manner permitting said replaceable plunger to engage the free end of said spindle via said central threaded bore in said replaceable plunger; and rotating said knurled nut for rotating said spindle in a direction for drawing said stick adhesive and associated said plunger from said refill tube into said holder as said spindle screws into said replaceable plunger and penetrates more deeply into said blind hole of said stick adhesive, the diameter of said blind hole being determined for insuring said replaceable plunger cuts only slightly into said stick adhesive.

2. A process for the production of a refill cartridge for a stick adhesive dispenser, which releases adhesive by application of an end of said stick adhesive to a surface, said process comprising a holder including an opening at one end, and a replaceable plunger designed for axial displacement over the length of the holder to apply said stick adhesive accommodated in the holder, whereby said refill cartridge is produced by filling a tube with liquified stick adhesive material, said tube being configured to the internal volume of a dispenser designed to accommodate the particular stick adhesive, and to the internal configuration of said holder, said tube having a base with a centrally located internal pin extending therefrom for forming a blind hole having a diameter sized for receiving a screwthreaded spindle that cuts slightly into said stick adhesive after solidification, said stick adhesive is ejected from the tube as a molding of said stick adhesive material, for insertion into the refill cartridge with a said replaceable plunger being attached to an end of said molding protruding from said refill cartridge, said plunger being formed throughout with a central screwthreaded bore, said plunger being introduced into the base of the tube.

3. A refill cartridge for a dispenser for stick adhesive which releases adhesive by application of an end of said stick adhesive to a surface, said dispenser including a holder which is designed for closure by a cap, an opening at at least one end, an internal replaceable plunger designed for axial displacement upon a rotatable screwthreaded spindle over the length of the holder to apply said stick adhesive accommodated in the holder, wherein the improvement comprises said refill cartridge including:

a tube having a closed end, and an open end;

a molding of the material of said stick adhesive adapted to the internal volume, designed to accommodate said stick adhesive and internal configuration of the holder, said molding being formed with a central axially aligned blind hole and contained in said tube with the blind hole exiting at the open end of said tube; and said replaceable plunger being secured to said molding at the open end of said tube, wherein said plunger is formed throughout with a central screwthreaded bore, said plunger being aligned with said bore opposing the exit of said blind hole.

4. A refill cartridge as claimed in claim 3, further including the screwthreaded bore being closed by a membrane designed to be pierced by the screwthreaded spindle.

5. A refill cartridge as claimed in claim 3, wherein the screwthreaded bore has at least a single screwthreaded.

6. A refill cartridge as claimed in claim 3 further including the base of the plunger being formed internally with a cone as an insertion aid for an end of said spindle.

7. A refill cartridge as claimed in claims 3, wherein the wall thickness of the tube is equal to that of the holder.

8. A refill cartridge as claimed in claim 3, wherein the tube and the plunger are made of plastic.

9. A refill cartridge as claimed in claim 3, wherein the inner surface of said tube is made slightly conical in shape, the conical taper towards an end opposite the plunger forming a cone angle of at most 3°.

10. A refill cartridge as claimed in claim 3, wherein the adhesive stick consists of a spreadable adhesive.

11. The refill cartridge of claim 3, further including:

a hollow sleeve having thin side walls, said sleeve including first annular snap in joint means proximate a top edge of said sleeve, for mating with second annular snap in joint means proximate the open end of said tube, thereby permitting said sleeve to be snapped onto the open end of said tube, the interior configuration of said sleeve being dimensioned to provide sufficient space between interior wall portions of said sleeve and side walls of a said replaceable plunger secured to said molding of said stick adhesive, for permitting the space to receive a portion of the said one end of said holder to mount said refill cartridge onto said holder, thereby facilitating the transfer of said molding of said stick adhesive with said replaceable plunger from said tube into said holder.

* * * * *